United States Patent [19]

Watabe et al.

[11] Patent Number: 4,714,908

[45] Date of Patent: Dec. 22, 1987

[54] ELECTROMAGNETIC DEFLECTION-DISTORTION CORRECTOR

[75] Inventors: Seiji Watabe, Honjo; Isao Yokoyama, Nikaho; Masanori Sasaki, Kisakata; Yotaro Toyoshima; Sumio Takahashi, both of Nikaho, Japan; Tsutomu Maeda, Wako, all of Japan

[73] Assignee: TDK Corporation, Tokyo, Japan

[21] Appl. No.: 806,167

[22] Filed: Dec. 6, 1985

[30] Foreign Application Priority Data

Dec. 13, 1984 [JP] Japan ..... 59-261826

[51] Int. Cl.[4] ..... H01F 1/00

[52] U.S. Cl. ..... 335/212; 335/210

[58] Field of Search ..... 335/210, 212, 213, 302, 335/306; 313/426, 427

[56] References Cited

U.S. PATENT DOCUMENTS

| | | | |
|---|---|---|---|
| 2,883,569 | 4/1959 | Kaiser et al. | 335/212 |
| 2,899,579 | 8/1959 | Kirkham et al. | 335/212 |
| 3,247,426 | 4/1966 | Havn | 335/212 |
| 3,781,731 | 12/1973 | Poel | 335/212 |
| 4,197,487 | 4/1980 | Takenaka et al. | 335/212 X |
| 4,253,078 | 2/1981 | Tagawa et al. | 335/212 |

*Primary Examiner*—George Harris

*Attorney, Agent, or Firm*—Seidel, Gonda, Goldhammer & Abbott

[57] ABSTRACT

An electromagnetic deflection-distortion corrector comprises a plurality of permanent magnets arranged around the tubular wall of a CRT display unit of the electromagnetic deflection type, and adjuster means for moving each permanent magnet forward and backward, toward and away from the CRT wall, while at the same time rotating the direction of its magnetization.

7 Claims, 19 Drawing Figures

ELECTROMAGNETIC DEFLECTION-DISTORTION CORRECTOR

BACKGROUND OF THE INVENTION

1. Field of the Invention

This invention relates to a deflection-distortion corrector for cathode-ray tube (CRT) display unit, and more specifically to such a corrector using permanent magnets.

2. Description of the Prior Art

For the deflection of electron beam in CRT display units, a system known as electromagnetic deflection is predominantly used. The system, as typically shown in FIG. 2, employs horizontal and vertical deflection coils 3 arranged around the neck of the CRT 2 having a phosphor screen 1 and supplied with a current to deflect the path of electron beam 4 scanning the screen. Close to the deflection coils, there is usually provided a deflection yoke of a high-permeability ferrite core. It is common with such deflection system that the distance between the center of deflection and the center of the image is not always equal to the radius of curvature of the image and that, in designing the display device, the deflecting magnetic field distribution is chosen as a compromise between the resolution and the degree of pincushion or barrel distortion involved. In many cases, for these and other reasons, mere combination of a CRT and deflection yoke-coil assembly would cause the scanning to produce a pincushion distortion as indicated at (e) in FIG. 3 or a barrel distortion as at (f) in place of the normal rectangle at (a) of the same figure.

A countermeasure usually taken is a system of electronic circuits for adjusting the deflecting current to the optimum value for each of the horizontal and vertical coordinate points, a system of permanent magnets arranged close to the deflection coils to correct the residual distortion in each magnetic field they generate in the space, or both. However, if the residual distortion were to be corrected with high accuracy, the electronic circuit system would become too expensive. The permanent magnet system, on the other hand, is less expensive because they use fixed magnets, but permanent magnets of proper length and strength in proper arrangement are so complex to design that high-accuracy deflection distortion correction by the system is seldom realized. The permanent magnet system in use will now be explained by reference to FIGS. 1 and 4 illustrating the present invention. Around the tubular wall near the neck of a CRT 10, there are mounted a horizontal deflection coil (13), a vertical deflection coil 12, and a conical deflection yoke 11. To correct deflection distortions, four bar-shaped permanent magnets 14 are also disposed (FIG. 4). The visual presentation on a CRT display unit is, ideally, required to be of good linearity as represented by the raster at (a) of FIG. 3. In reality, correction by the permanent magnet system leaves residual distortions as at (b), (c), or (d) in FIG. 3, necessitating adjustments in the directions of the arrows. An attempt to combine the system with another corrector means of electronic circuits presents other problems of inevitable residual distortion where weight is placed on cost reduction, or very high cost of complete correction. Precise correction by the electronic circuits alone is again extremely costly.

Another system has recently been proposed which uses, in addition to the permanent magnets 14, much smaller permanent magnets surrounding the deflection coils to effect fine adjustments for correction of distortion with high accuracy. The system produces magnetic fields for fine adjustments which are variable in magnitude but are fixed in direction. The fields cannot be arbitrarily given any desired direction or magnitude, with the consequence that the path of correction the spot on the screen follows is circular or elliptical and correction cannot be achieved as intended. The present invention is concerned with an improvement in the correction technique of this character.

SUMMARY OF THE INVENTION

The present invention aims at providing means for enabling a distortion corrector for a CRT display unit of the electromagnetic deflection type to perform the correction of distortions simply, economically, and with high accuracy.

The invention thus provides a distortion corrector for a CRT display unit of the electromagnetic deflection type characterized by the use, as permanent magnets for fine adjustments, a plurality of small magnets arranged around the deflection coils and made adjustable in angle and position by screw means or the like.

According to this invention, the magnitude and direction of each magnetic field applicable to each coordinate point that requires fine adjustment are freely chosen as desired. Hence, each point that needs correction can be corrected in desired direction over a desired distance, and high-accuracy correction accomplished in a simple way. Where distortion-correcting main permanent magnets and/or electronic circuits are used, their rough correction can be combined with the fine adjustment according to the invention to realize economical distortion correction.

DETAILED DESCRIPTION OF THE INVENTION

The fine-adjusting permanent magnets according to the invention are held by support means in such a manner that their back-and-forth movement and angle of rotation are adjustable by screw means or the like. In this way the direction and magnitude of the magnetic field each magnet produces can be arbitrarily set with respect to the particular coordinate point where adjustment is to be made. These permanent magnets have only to be provided in a number (eight, in the embodiment being described) corresponding to the number of coordinate points requiring precise correction. The screw or other similar means must simply force the individual magnets toward or away from the path of electron beam corresponding to given coordinate points. It should be obvious to those skilled in the art that their movement need not to be parallel to the axis of the CRT, as will be explained later in connection with embodiments of the invention. In order to reduce the magnetic field of each fine-adjusting magnet in its retracted position to naught, it is only necessary to design the arrangement so that the magnetic field of each magnet in that position be almost completely absorbed by the deflection yoke.

Figure 1:
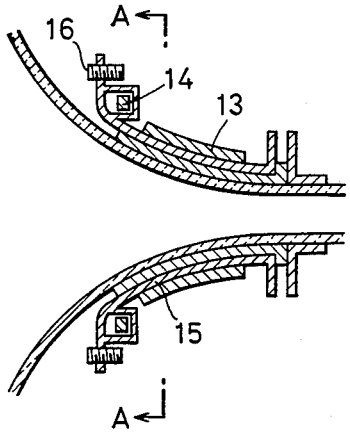
FIG. 1 is a vertical sectional view of a CRT equipment with the distortion corrector according to the present invention.
Figure 2:
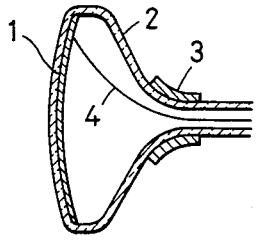
FIG. 2 is a vertical sectional view of a conventional CRT, showing its basic construction.
Figure 4:
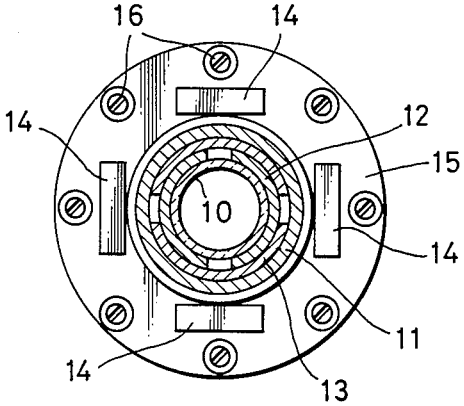
FIG. 4 is a cross section as viewed in the direction of arrows A—A of FIG. 1.
Figure 3A:
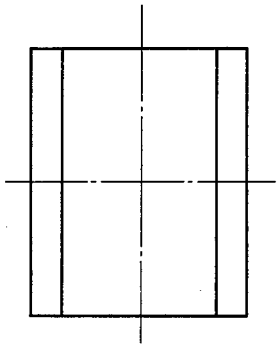
FIG. 3 shows rasters with no or varied distortions.
Figure 3B:
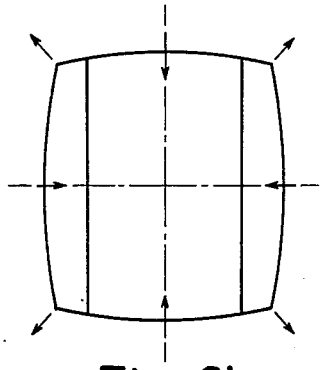
Figure 3C:
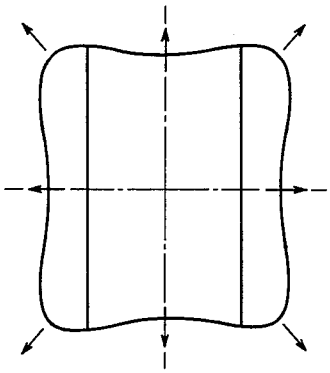
Figure 3D:
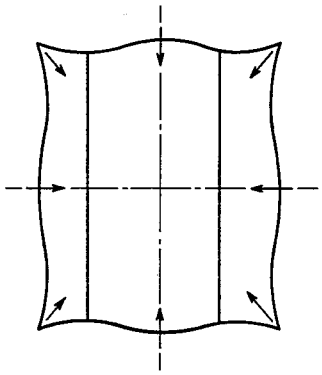
Figure 3E:
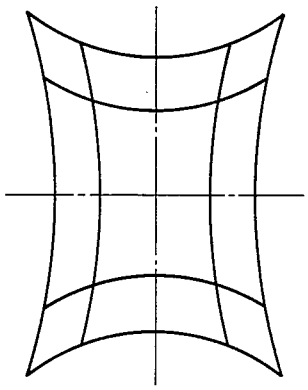
Figure 3F:
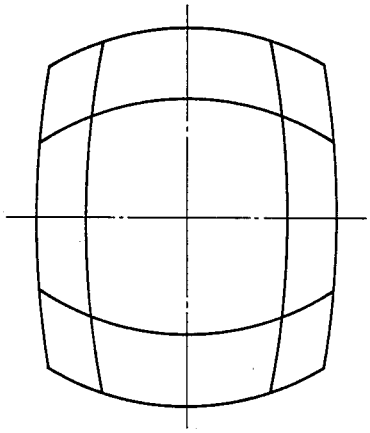
Figure 5:
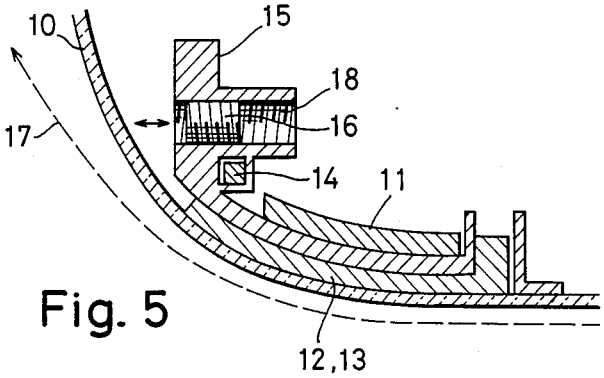
FIG. 5 is an enlarged view of the essential parts of FIG. 1.

Embodiments of the invention will now be explained. FIG. 1 is a vertical section through a CRT equipped with fine-adjusting permanent magents for distortion correction according to the invention, FIG. 4 is a section taken along the line A—A of FIG. 1, and FIG. 5 is an enlarged view of FIG. 1. The invention is embodied here as using distortion-correcting main electronic circuits or main permanent magnets.

Around the conical tube wall at the neck of a CRT 10 are fitted, in the usual manner, a vertical deflection coil 12, a horizontal deflection coil 13, and a deflection yoke 11 of sintered ferrite material. These components are not limited in design and structure to those shown but other known components of different designs or structures may be employed instead. For rough correction of distortions, distortion-correcting main permanent magnets 14 (or distortion-correcting main electronic circuits) are carried by an appropriate nonmagnetic support frame 15 around the deflection yoke and coils. These main permanent magnets act to correct the pincushion distortion (e) or barrel distortion (f) of the raster in FIG. 3 to the form (b), (c), or (d). The deflected image must be further corrected in the direction of arrows.

FIRST EMBODIMENT

Figure 6:
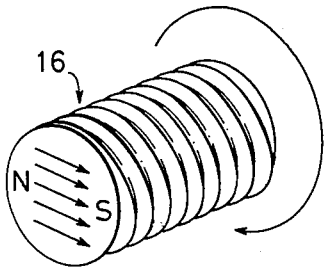
FIG. 6 is a perspective view of a fine-adjusting permanent magnet embodying the invention.

In this embodiment, therefore, fine-adjusting permanent magnets 16 are arranged, in addition to the main permanent magnets 14, around the CRT, so that the smaller magnetic field of each fine-adjusting magnet acts on the path 17 of electron beam to effect desired correction. As shown on an enlarged scale in FIG. 5, the inwardly extending annular flange of the support frame 15 made of plastic or other nonmagnetic material has a plurality of threaded holes 18 at points conforming to the points where the raster correction is to be done. With these holes are engaged a corresponding number of the permanent magnets 16 each of which, as enlarged in FIG. 6, is externally threaded and diametrally magnetized. The magnets also have a slot or recess formed in one end to receive the tip of a screwdriver. Turning to FIG. 5, the threaded holes 18 of the support frame are extended away from the tube wall to a length enough to provide an adequate distance for movement of the individual permanent magnets 16. Desirably, the locations of these holes are fixed so that, when each magnet has been retracted to the full, its magnetic field is substantially completely absorbed by the deflection yoke 11. The strength of the permanent magnets 16 is so chosen as to enable each magnet to make the necessary amount of correction when it has moved to the point nearest to the CRT wall. As shown, the direction of magnetization of each fine-adjusting permanent magnet 16 turns as the magnet moves in thread engagement with the hole. In this way the magnitude and intensity of the correcting magnetic field applied to a preselected position inside the CRT wall can be freely changed within the range of magnetization of the permanent magnet 16.

Figure 8:
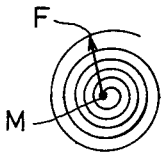
FIG. 8 is a view illustrating a path for correction of a fine-adjusting permanent magnet according to the invention.

By way of explanation, it is assumed that, as indicated in FIG. 8, a given coordinate point of a deflected image formed by a deflecting magnetic field applied to the electron beam in the CRT has been roughly corrected to the point M by a distortion-correcting main permanent magnet 14. For distortionless correction it is further assumed that fine adjustment to the normal position F is necessary. Apparently, MF is a vector quantity and its correction requires a magnetic field with properly chosen direction and magnitude. The fine-adjusting permanent magnets 16 of the invention produce magnetic fields of this character. Referring back to FIG. 5, as a screwdriver or other similar tool, inserted into one of the threaded holes 18 with its tip fitted in the slot or recess at one end of the magnet 16 therein, is turned clockwise, the magnet 16 is driven forward, gradually reducing the distance between itself and the wall of the CRT. The magnetic field applied to the path of electron beam grows accordingly in magnitude, and its direction is rotated trough 360 deg. per pitch of the screw. Correspondingly, the electron beam path being corrected draws a spiral on the screen as indicated in FIG. 8. Thus, choosing an appropriate distance of forward movement and angle of rotation enables the permanent magnet 16 easily to achieve the correction to the objective correction point F. In this way precise distortion correction is made possible in accordance with the invention.

SECOND EMBODIMENT

In the first embodiment, the distortion-correcting main permanent magnets are replaced by the electronic circuit system to perform rough, main correction. In this second embodiment the circuitry is built far more economically than that which electronically performs all correction up to fine adjustment.

THIRD EMBODIMENT

Figure 7:
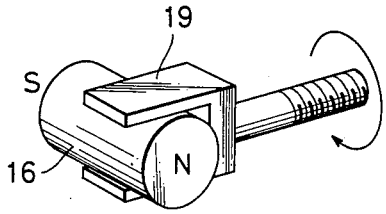
FIG. 7 is a perspective view of a fine-adjusting permanent magnet in another embodiment of the invention.

Referring to FIG. 7, there is shown a cylindrical magnet 16 held by a partly threaded support 19, as compared with the fine-adjusting permanent magnet 16 of FIG. 1 which is threaded on itself. The magnet in the third embodiment, with its direction of magnetization at right angles to the axis of the threaded shank of the support, functions and achieves effects in the same manner as with the preceding embodiments.

As has been described above, the present invention is characterized in that, in a distortion correction system using fine-adjusting permanent magnets arranged close to the deflection coils external to the CRT, the direction of magnetization of each fine-adjusting permanent magnet is turned through 360 deg. to any desired direction as the magnet moves ahead toward, or backward away from, the confronting wall of the CRT. In this manner the correction magnetic field applied to the path of electron beam is allowed to have a desired magnitude and direction and thereby correct any deflection distortion to the normal distortionless state. Proper choice of the surface magnetic flux density and total number of produced magnetic fluxes of the fine-adjusting permanent magnets 16, the number of magnets, pitch and lead of screw thread thereon, etc. makes it possible to design with ease a corrector capable of fine adjustments with desired accuracy.

The present invention is also applicable to cases in which the absolute amount of pincushion or barrel distortion is too small to justify the use of ordinary main correction magnets or electronic circuits. In such cases the main correction means may be eliminated because the fine-adjusting permanent magnets of the invention alone can correct the distortion accurately.

FOURTH EMBODIMENT

Figure 9:
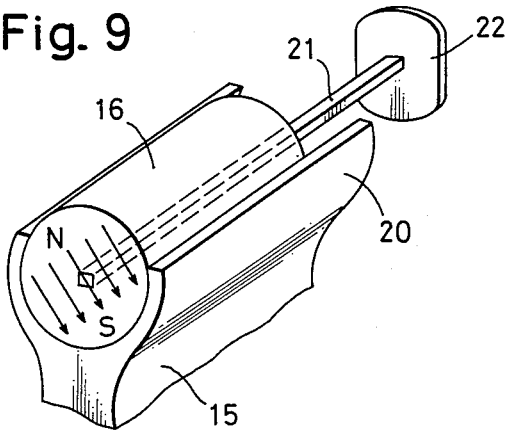
FIG. 9 is a perspective view of the fine-adjusting permanent magnet and its retainer of the fourth embodiment.

FIG. 9 illustrates a fine-adjusting permanent magnet. In the forgoing embodiments, the magnet was revolved and translated using thread. In this embodiment, the threaded shank is replaced by a radially magnetized cylindrical bar permanent magnet 16 which is supported by a more than semi-cylindrical inner surface of a non-magnetic retainer 20 secured to the support frame 15. The retainer 20 includes a pair of resilient walls which bear against the surface of the cylindrical bar magnet 16. A rectangular bar 21 of a handle 22 extends through the complemental axial hole of the magnet 16. Manual operation of the handle 22 allows an efficient axial positioning of the magnet 16 as well as angular positioning.

FIFTH EMBODIMENT

Figure 10:
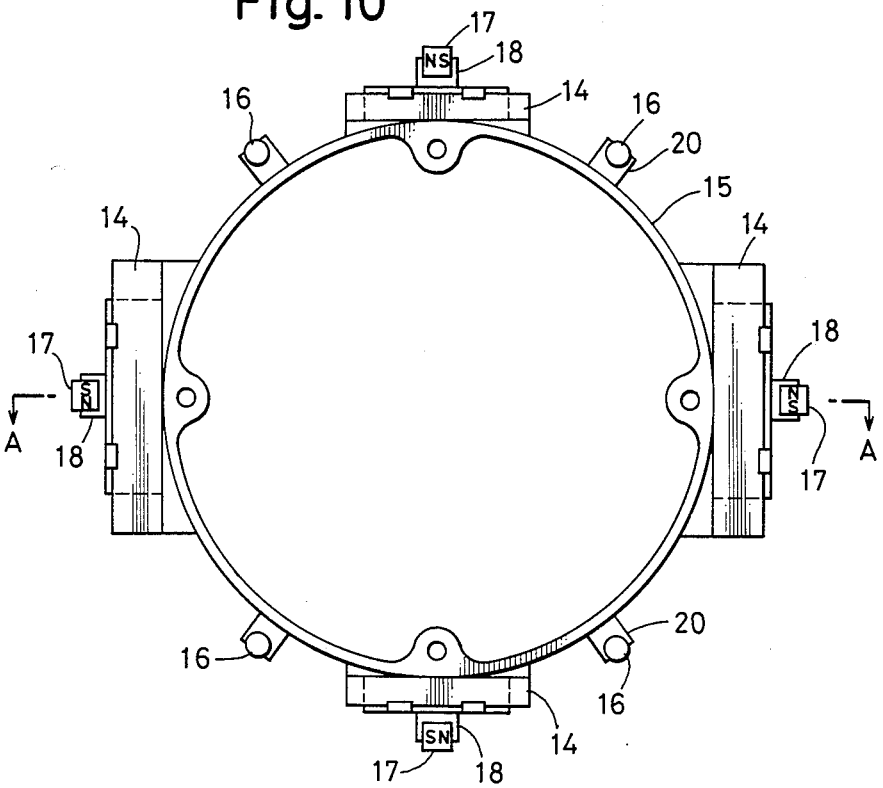
FIG. 10 is a front view of the distortion-correction device of the fifth embodiment.
Figure 11:
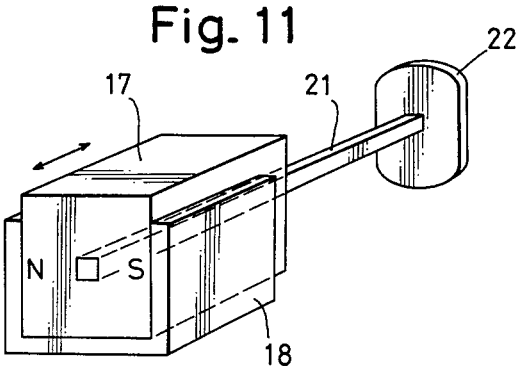
FIGS. 11, 12, 13 and 14 are perspective views of various fine-adjusting permanent magnets which are alternatively used in the fifth embodiment shown in FIG. 10.
Figure 12:
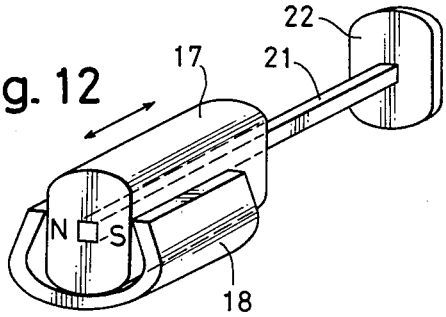
Figure 13:
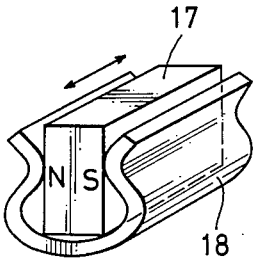
Figure 14:
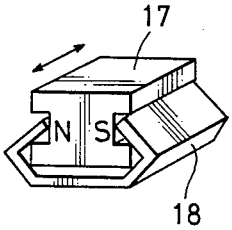

FIG. 10 illustrates the fifth embodiment of the invention. The main correction permanent magnets 14 are supported by the support frame 15. Fine-adjusting permanent magnets 16 and 17 are respectively supported by retainers 20 and 18 secured to the support frame 15. The magnets 16 and the supports 20 are similar to that of the fourth embodiment in FIG. 9 but may be those of the other embodiments. The magnets 17 are rectangular in cross section as they are not required to be revolved for fine correction of distortion because the distortion corrections on the horizontal and vertical lines passing through the center of the CRT are needed only in the directions along these two lines (See FIG. 3 (b), (c) and (d)). Thus, in place of the cylindrical bar magnets 16, the bar magnets 17 can only be adjusted axially and the resilient retainers 18 prevent them from rotating. More concrete structure of the magnets 17 and the retainers 18 may be one of those illustrated in FIGS. 11, 12, 13 and 14 (the members 21, 22 are omitted in FIGS. 13 and 14).

What is claimed is:

1. An electromagnetic deflection-distortion corrector for a cathode-ray tube display unit of the electromagnetic deflection type, the corrector comprising: a plurality of permanent magnets arranged adjacent and around the tubular rear wall of the cathode-ray tube display unit, and adjustor means for moving each permanent magnet forward and backward, towards and away from the tube wall in a direction parallel to the longitudinal axis of the cylindrical neck of the cathode-ray tube, whereby residual distortion of the deflection pattern of the electron beam on the face plate of the cathode-ray tube is corrected by means of the movement of the permanent magnets.

2. An electromagnetic deflection-distortion corrector according to claim 1, wherein said each adjuster means is also adapted to rotate the permanent magnet.

3. An electromagnetic deflection-distortion corrector according to claim 2 wherein the permanent magnets are externally threaded and the direction of magnetization thereof is substantially at right angles to the direction of advance of the screw thread.

4. An electromagnetic deflection-distortion corrector according to claim 2 wherein the permanent magnets are each supported by a partly threaded support and the direction of magnetization thereof is substantially at right angles to the direction of advance of the screw thread.

5. An electromagnetic deflection-distortion corrector according to claim 1 wherein the cathode-ray tube display unit further comprises a plurality of distortion-correcting main permanent magnets and/or distortion-correcting main electronic circuits arranged fixedly around the tube wall of the cathode-ray tube.

6. An electromagnetic deflection-distortion corrector according to claim 2 wherein the permanent magnets have a cylindrical smooth surface and supported by a resilient retainers and the direction of magnetization thereof is substantially at right angles to the direction of advance of the magnet.

7. An electromagnetic deflection-distortion corrector according to claim 1 wherein the permanent magnets on the vertical and/or horizontal axis passing through the center of the tube are rectangular in cross section and supported by a resilient retainers and the direction of magnetization thereof is substantialy at right angles to the direction of advance of the magnet.

* * * * *